US007802854B1

(12) United States Patent
Lane et al.

(10) Patent No.: US 7,802,854 B1
(45) Date of Patent: Sep. 28, 2010

(54) SYSTEM FOR REMOVING SHINGLES FROM A ROOF

(75) Inventors: Ronald C. Lane, Inman, SC (US); Mitch Jolley, Spartanburg, SC (US); Nathan Grizzard, Moore, SC (US)

(73) Assignee: Advanced Roofing Technologies, Inc., Spartanburg, SC (US)

( * ) Notice: Subject to any disclaimer, the term of this patent is extended or adjusted under 35 U.S.C. 154(b) by 859 days.

(21) Appl. No.: 11/372,728

(22) Filed: Mar. 10, 2006

(51) Int. Cl.
*E04D 15/02* (2006.01)

(52) U.S. Cl. ..... 299/37.1; 299/39.2; 81/45; 30/170

(58) Field of Classification Search ..... 81/45; 299/37.1, 39.1, 39.2, 39.8; 30/170; 15/93.1; 52/749.12
See application file for complete search history.

(56) References Cited

U.S. PATENT DOCUMENTS

| | | | | | |
|---|---|---|---|---|---|
| 2,905,456 | A | * | 9/1959 | Rafferty et al. | 299/39.8 |
| 3,251,629 | A | * | 5/1966 | Cawley | 299/37.5 |
| 3,272,559 | A | * | 9/1966 | Haynes | 299/37.1 |
| 3,542,433 | A | | 11/1970 | Probst | |
| 3,697,137 | A | * | 10/1972 | Krekeler | 299/106 |
| 3,945,681 | A | * | 3/1976 | White | 299/107 |
| 4,053,183 | A | | 10/1977 | Probst | |
| 4,625,438 | A | * | 12/1986 | Mozer | 37/447 |
| 4,664,447 | A | | 5/1987 | Clark | |
| 4,880,491 | A | | 11/1989 | Jacobs et al. | |
| 5,098,165 | A | | 3/1992 | Jacobs et al. | |
| 5,337,965 | A | | 8/1994 | Chivitti | |
| 5,381,597 | A | | 1/1995 | Petrove | |
| 5,626,194 | A | * | 5/1997 | White | 169/24 |
| 5,638,616 | A | * | 6/1997 | Kishi | 37/186 |
| 6,070,498 | A | | 6/2000 | Mislich et al. | |
| 6,484,422 | B1 | | 11/2002 | Bain et al. | |
| 6,711,971 | B1 | | 3/2004 | Morin | |
| D509,835 | S | | 9/2005 | Byrne | |
| 2006/0032095 | A1 | * | 2/2006 | Buckner | 37/304 |
| 2007/0164597 | A1 | * | 7/2007 | Brown | 299/39.1 |

FOREIGN PATENT DOCUMENTS

| | | | | |
|---|---|---|---|---|
| JP | 10151423 | A | * | 6/1998 |
| JP | 11193643 | A | * | 7/1999 |

* cited by examiner

*Primary Examiner*—Sunil Singh
(74) *Attorney, Agent, or Firm*—Hunter S. Freeman; McNair Law Firm, P.A.

(57) ABSTRACT

The invention is directed towards a system and method for removing shingles from a roof comprising a shingle removal head, a boom arm assembly, a vacuum, and a containment bin. The head includes a frame that defines a shingle disposal area and includes a prying member having a lifting surface for engaging the underside of shingles and lifting them from the roof and directing them to the shingle disposal area. The head also includes a cutting member for receiving and decreasing the size of the removed shingles for removal from the head by the vacuum into the containment bin, both of which may be carried by a transportation unit. The head may be attached to the boom arm assembly that is carried by a transportation unit so that the assembly causes the head to engage and lift shingles from a roof, allowing operation of the head frame from the ground.

20 Claims, 8 Drawing Sheets

SYSTEM FOR REMOVING SHINGLES FROM A ROOF

BACKGROUND OF THE INVENTION

Over time, the shingles of a roof must be replaced to prevent leaking, which causes damage to the roof and the structure for which the roof provides protection. In order to replace the shingles, first the old shingles must be removed so that the new shingles can be placed on the roof. Removing the shingles from the roof is a long arduous process that is usually done manually. The invention is directed towards a system and method for removing shingles from a roof.

Previous apparatus and methods have been provided for removing shingles from a roof. Some of these involve the use of a hand held prying device used to lift the shingles from the roof. However, this requires the user to get on top of the roof and physically pry the shingles loose from the roof. Further, once the shingles are pried from the roof there is no place to store the loose shingles, thereby creating a large mess that necessitates a great deal of cleaning.

Another manual apparatus used to remove shingles from a roof includes an angled blade that is designed to pry shingles loose from a roof. Again, this apparatus requires the operator to be on the roof in order to remove the shingles, which risks injury to the operator should he fall off of the roof. To prevent such injury, the apparatus includes a bulky guide system that helps to prevent the apparatus or the operator from falling from the roof. This guide system, however takes a considerable amount of time to put in place. Further, there is no means for disposal of the removed shingles, again creating a large mess that requires cleaning time.

Other devices used include various mechanisms to pry the shingles loose from a roof. All of these devices, however, require that the operator be on the roof to remove the shingles. Further, none of these devices include a mechanism for disposing the shingles removed from the roof.

Accordingly, an object of the present invention is to provide a faster and less labor intensive system, apparatus and method for removing shingles from a roof.

Another object of the invention is to provide a remotely operated system and method for removing shingles from the roof.

Yet another object of the invention is to provide a system and method for removing shingles from a roof and disposing of the removed shingles.

Still another object of the invention is to provide a integrated system and method for removing shingles from a roof, shredding the shingles in to pieces and delivering the pieces to a vacuum disposal unit.

SUMMARY OF THE INVENTION

The present invention is directed towards an apparatus for removing shingles from the surface of a roof comprising a moveable shingle removal head having a frame, a prying member carried across a prying width by the head frame for lifting and removing shingles from the surface of the roof, a cutting member carried by the head frame for cutting the removed shingles into smaller shingle pieces, a shingle disposal section carried by the head frame for receiving the shingle pieces, and a shingle outlet formed in the shingle disposal section for the removal of the shingle pieces from the shingle disposal section, whereby, when the apparatus is positioned and moved over shingles on a roof, the prying member engages beneath free edges of the shingles to lift and remove the shingles for being cut into shingle pieces for removal from the shingle disposal section through the shingle outlet.

The invention may further include a support member carried by the head frame and a safety mechanism carried by said support member and operatively connected to the prying member allowing biased reciprocal movement of the prying member along a longitudinal axis for retraction of the prying member upon contacting an elevated obstruction, whereby, during movement of the head frame over the surface of the roof, contact of the prying member with the elevated obstruction causes the prying member to retract along the axis into a position elevated from the obstruction allowing the prying member to continue movement over the surface of the roof.

The invention may further include a guide member carried by the head frame with the prying member for directing the shingles removed by the prying member toward the shingle disposal section. The invention may also include a width trimming member carried by the head frame and disposed adjacent the prying member for defining the prying width by cutting a predetermined width of shingles to be removed from the roof by the prying member.

The invention may further include a vacuum unit connected to the shingle outlet by a vacuum hose for removing the shingle pieces from the shingle disposal section.

The invention may further include a prying member that comprises a plurality of prying elements spaced across the prying width of the head frame and guide members carried adjacent the prying elements for directing the shingles removed by the prying elements toward the shingle disposal section.

The invention may further include a safety mechanism carried by the head frame and operatively connected to the prying elements allowing biased reciprocal movement of the prying elements along a longitudinal axis for individual retraction of the prying elements upon contacting an elevated obstruction, whereby, during movement of the head frame over the surface of the roof, contact of one or more of the prying element with the elevated obstruction causes one or more of the prying elements to retract along the axis into a position elevated from the obstruction allowing the prying elements to continue operative movement over the surface of the roof.

The invention may further include a width trimming member carried by the head frame and disposed adjacent the two outermost prying elements for defining the prying width by cutting a predetermined width of shingles to be removed from the roof by the prying elements.

The invention may further include a cutting member that comprises a rotatable blade and a cutting bar having a slot corresponding to the blade so that when the blade is rotated, it passes through the slot to break the removed shingles into the smaller shingle pieces.

The invention may further include a boom arm assembly for carrying and remotely operating the shingle removal head frame so that the boom arm assembly causes the head frame to be positioned and moved over the surface of the roof thereby removing shingles from the surface of the roof. The boom arm assembly may include two articulating arms including a base arm and an extension arm, where the base arm is rotatably carried by the transport unit about a vertical axis and the extension arm being pivotally carried by the base arm on which the removal head is carried. The extension arm may comprise a telescopic arm extendable to move the head frame over selected areas of the roof.

The boom arm assembly may further include an adjustable connector for adjusting the angle at which the removal head is carried by the extension arm so as to match the angle at which the shingle removal head frame is carried by the boom to the pitch of the roof. The adjustable connector may comprise a fluid cylinder connected to the head having the ability to extend and retract to adjust the angle at which the removal head frame is carried by the boom arm assembly.

The present invention is also directed towards a method for removing shingles from a roof and delivering the removed shingles to a ground unit comprising the steps of providing a shingle removal head for removing shingles from the roof, moving the removal head over the roof using a boom arm assembly to remove the shingles from a selected area of the roof, remotely controlling the boom arm assembly to move the shingle removal head over the selected area of the roof; and delivering the removed shingles from the roof to the ground unit.

The method may further comprise the steps of removing the shingles by using one or more prying members to lift and remove the shingles from the roof, cutting the removed shingles into smaller shingle pieces and delivering the shingle pieces to a ground unit, delivering the shingle pieces from the roof using a vacuum unit based at the ground unit and using a vacuum hose connected to the shingle removal head and the vacuum unit for receiving and delivering the shingle pieces from the head to the vacuum unit on the ground.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
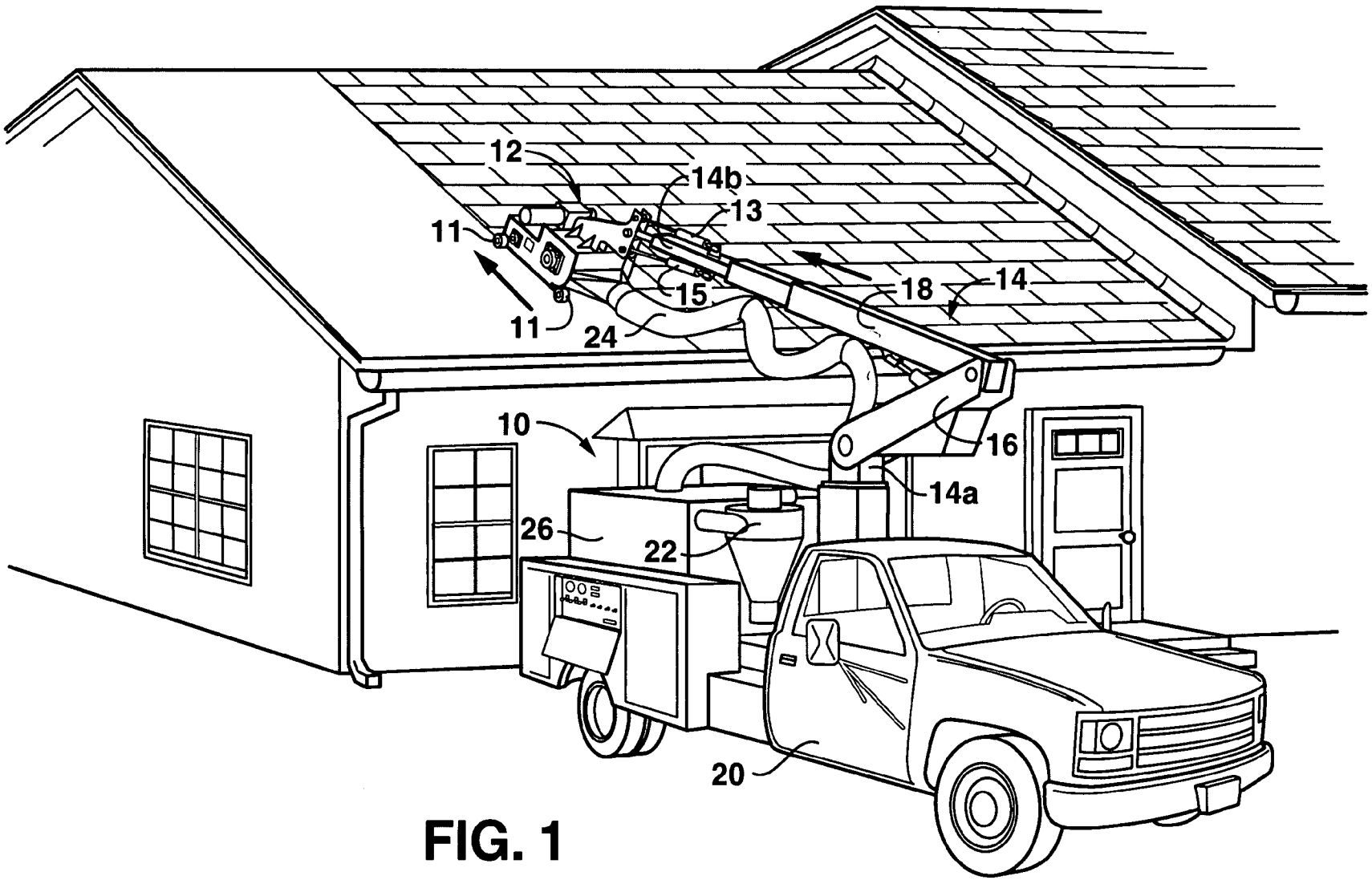
FIG. 1 is a perspective view illustrating a remotely controlled, integrated system and method for removal and disposal of shingles during use.

Referring now to FIG. 1, a remotely controlled, integrated system and method for removal and disposal of shingles is generally shown as 10. The invention includes a shingle removal head for removing shingles from a roof generally designated as 12. Shingle removal head 12 is pivotally carried by a boom arm assembly generally shown as 14. The boom arm assembly includes a first end 14*a* rotatably carried by a transportation unit 20 and a second end 14*b* which carries shingle removal head 12. The boom arm assembly, which is of generally known construction, may comprise a first arm 16 pivotally carried by first end 14*a* and a second arm 18 pivotally carried by first arm 16. As can be seen in this Figure, second arm 18 may extend telescopically to allow the boom arm to move shingle removal head 12 over the entire roof. While the use of boom arm assembly having at least one arm with the ability to telescopically extend provides the advantage of a more compact boom arm system, a boom arm assembly having a first and second arm that have one or more hinges to allow the second arm to extend and retract as needed may be used. Transportation unit 20 may be a trailer, a bed of a truck or any other means generally known in the art for portably carrying the boom arm assembly.

The invention further comprises a vacuum unit 22, of generally known construction and carried by transportation unit 20 having a vacuum hose 24 that is carried by boom arm assembly 14. Vacuum hose 24 may be carried by boom arm assembly 14 in such a manner that when boom arm assembly is not fully extended there is an excess amount of vacuum hose creating slack in the hose or in such a manner that vacuum hose has the ability to extend telescopically as the second arm 18 extends over the roof.

In use, boom arm assembly 14 causes shingle removal head 12 to engage a roof and lift the shingles secured to the surface of the roof. To ensure constant contact between the shingle removal head and the surface of the roof and to provide greater ease of movement of the shingle removal head while engaging the surface of the roof, shingle removal head 12 is provided with wheels 11. Once shingle removal head has removed the shingles from the surface of the roof, vacuum unit 22 creates enough suction to transport the removed shingles from shingle removal head 12, down vacuum hose 24 and into containment bin 26 so that the removed shingles may be disposed of properly when the job is done.

FIG. 1 illustrates shingle removal head 12 as it removes shingles from the surface of a roof by moving from the bottom of the roof to the apex in successive passes. Such a method is typically employed because shingles are generally secured to a roof in an successive overlapping rows that are parallel to the roofs apex with the first row being secured closest to the gutter and each successive row being secured closer to the apex of the roof. Therefore, the invention removes shingles by moving the shingle removal head perpendicularly to the apex of the roof, whereby the shingles closest to the bottom of the roof near the gutter are removed first while the shingle removal head moves towards the apex of the roof. However, the invention could also remove shingles moving the shingle removal head parallel to the apex of the roof, whereby the shingles from one side of the roof are removed first while the shingle removal head moves towards the opposite side of the roof.

While the boom arm assembly provides additional safety by alleviating the need for the operator to physically be on the roof while operating the shingle removal head for removing shingles from a roof, the shingle removal head could also be manually operated to remove shingles from the roof.

Figure 2:
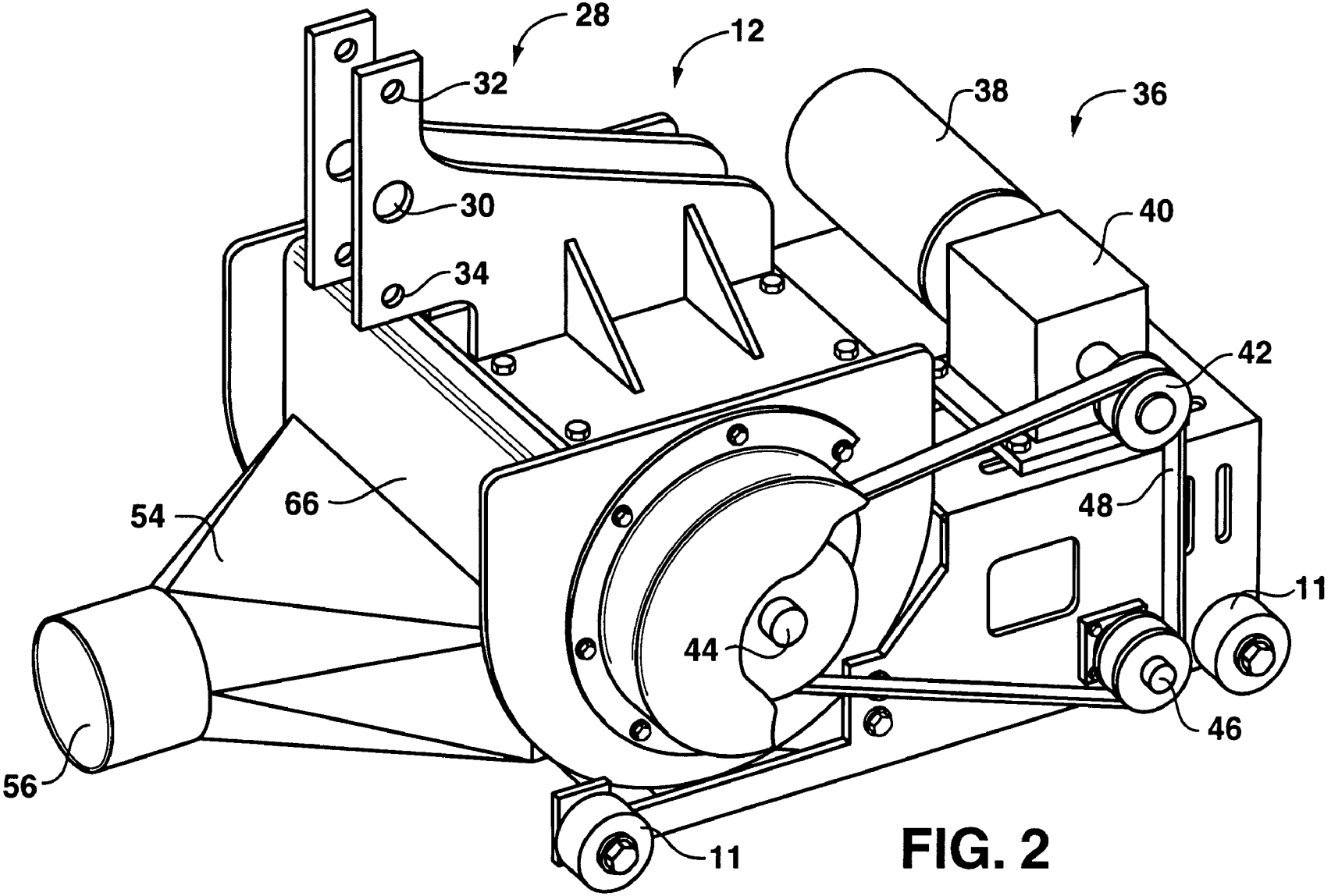
FIG. 2 is a perspective view illustrating a portion of the invention.

Referring now to FIG. 2, the shingle removal head, generally shown as 12, includes an attachment assembly, generally shown as 28, for pivotally connecting the shingle removal head to the boom arm assembly. Attachment assembly 28 includes a center support opening 30 for supporting the shingle removal head and secondary support openings 32 and 34 for connecting the shingle removal head to adjustable connectors, shown as 13 and 15 in FIG. 1 contained on the boom arm assembly. The adjustable connectors comprise fluid cylinders such as hydraulic supports that articulate the angle at which shingle removal head is carried by the boom arm assembly to match the pitch or other angle of the roof from which the shingles are to be removed.

Figure 3:
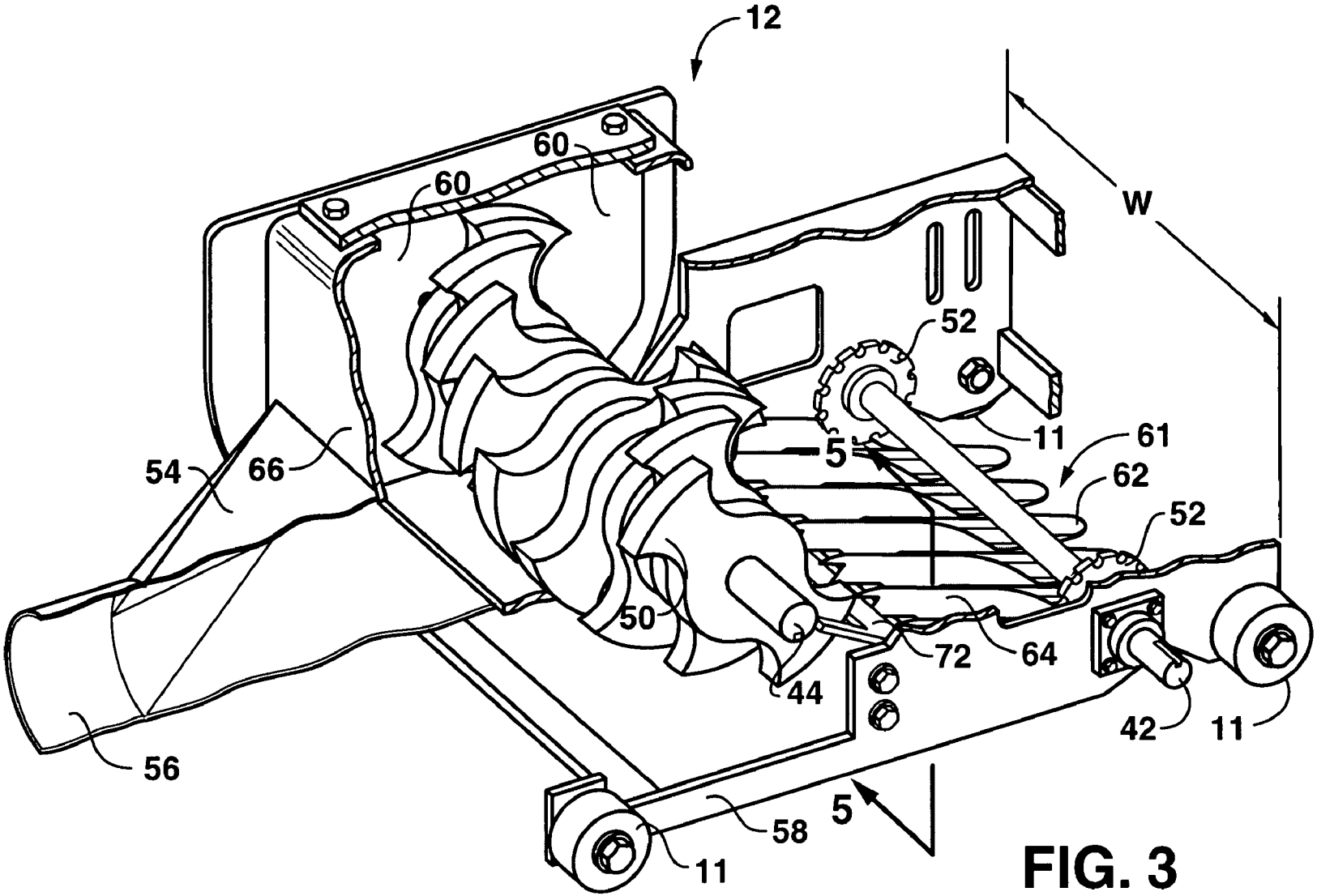
FIG. 3 is a perspective view of a portion of the invention having a cut away further illustrating a portion of the invention; and, FIGS. 4*a*-4*d* are perspective views having a cutaway illustrating a portion of the invention during use; and, FIG. 5 is a side elevation view illustrating a cross section of a portion of the invention.

As can be seen in FIGS. 2 and 3, the shingle removal head further includes a shingle disposal housing 66 that is carried by the frame of the shingle removal head and defines a shingle disposal section 60. The purpose of shingle disposal housing 66 is to contain the shingles pieces that have been cut by cutting blades 50 and cutting bar 72, which are collectively known as a cutting member (shown as 67 in FIGS. 4A-C). Shingle disposal housing 66 includes a protrusion 54. At the point where protrusion 54 is connected to shingle disposal housing 66, protrusion 54 and shingle disposal housing have the same width. However as protrusion 54 extends from shingle disposal housing 66, it tapers down to define a shingle outlet 56. Protrusion 54 is designed funnel the greatest amount of removed shingles that have been cut by cutting member 67 from shingle disposal section 60 to the shingle outlet 56. Shingle outlet 56 is designed to receive vacuum hose 24 so that vacuum unit 22 may remove the shingles shingle pieces and deposit them into containment bin 26.

While protrusion 54 helps prevent shingle disposal section 60 from becoming filled with shingle pieces cut by cutting member 67, shingle outlet 56 could be defined in shingle disposal section 60, without the use of protrusion 54.

Referring now to FIG. 2, shingle removal head 12 is provided with a drive 36, which may comprises an electric or gas motor 38 and a gear box 40. Drive 36 is responsible for rotating a drive shaft 42, which in turn rotates a primary cutting drive shaft 44 and a secondary cutting drive shaft 46 through the use of a belt 48. Primary cutting drive shaft 44 is responsible for rotatably driving blades 50, while secondary cutting drive shaft 46 is responsible for rotatably driving the width trimming member 52.

Figure 4A:
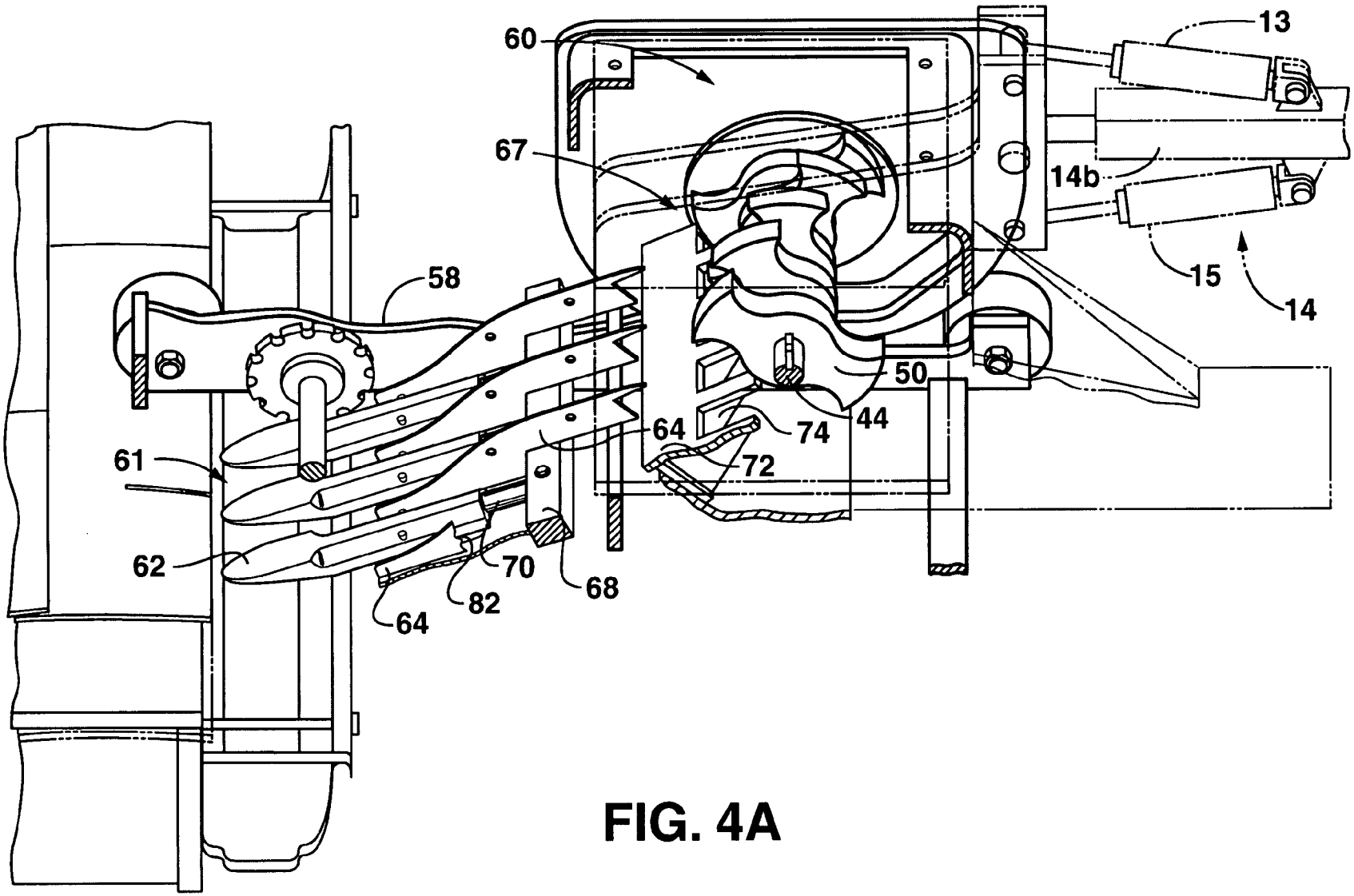

Referring now to FIGS. 3 and 4A, the internal workings of shingle removal head 12 may be viewed. The shingle removal head includes a prying member generally designated as 61, that is carried by a head frame 58. As illustrated, prying member 61 comprises a plurality of prying elements 62 that are carried across a prying width W. As illustrated, prying elements 62 are tapered, giving the prying elements a flat bottom for engaging the surface of a roof and an angled top for engaging the underside of a shingle to remove it from the surface of a roof.

Because of the number of prying members used, prying elements 62 are narrow and are horizontally spaced from one another. Depending on the number of prying elements 62 used, the prying elements could be horizontal spaced any desired distance from one another. The use of a plurality of horizontally spaced prying elements allows the shingle removal head to move along the roof with a reduced risk of one of the prying elements 62 contacting an obstruction existing on the roof and interrupting the removal process, as will be more apparent below.

Alternatively, prying member 61 may be a single plate or other unitary member that extends substantially across prying width W and having a prying edge, serrated teeth or other means of wedging between shingles and the surface of a roof generally known in the art.

As shingle removal head 12 is pulled across the surface of a roof, the prying member 61 wedges between the surface of the roof and the shingle to engage the underside of the shingles and lift them from the surface of the roof.

The invention further includes a width trimming member 52 that is carried by the frame 58 and rotatably driven by secondary cutting drive shaft 42. Width trimming member 52 acts to cut a predetermined width of shingles to be removed in a particular pass of shingle removal head 12 and is illustrated as a circular blade. As illustrated, the shingle removal head includes two width trimming members 52, both of which are carried by frame 58 and driven by the secondary cutting drive shaft such that each width trimming member 52 is disposed adjacent to the outer edge of prying member 61 so that the width of shingles removed in a single pass is only as wide as the prying width W of the shingle removal head 12.

The blade acts as a first cutting surface of the width trimming member 52, while the outermost edge of prying member 61 acts as a second cutting surface. As the shingles are lifted from the roof the width trimming member presses the shingles against the outer edge of prying member 61, creating enough resistance that the width trimming member is able to cut through the shingles. However, any other surface sufficient to act as a second cutting surface against which width trimming member may press the shingles to provide the resistance necessary to cut through the shingle may be used. Further, width trimming member 52 may comprise a circular blade, or any other member known in the art for cutting, slicing, tearing or shredding.

To ensure that the width trimming member cuts only the shingles and not the surface of the roof, width trimming member 52 is disposed a distance rearward from the leading edge of the prying member 61 and towards the shingle disposal section 60. The width trimming member is carried by secondary cutting drive shaft 42 and is vertically spaced from the bottom of the prying member 61 so that the shingles being removed must be elevated from the surface of the roof before encountering the width trimming member. Therefore, because wheels 11 and head frame 58 ensure that the width trimming member is elevated from the roof, the surface of the roof will not be damaged by width trimming member 52.

Preferably, guide members 64 are disposed adjacent to prying elements 62 to help direct the shingles removed from a roof by the prying elements to shingle disposal section 60. The number of guide members 64 correspond to the number of prying elements 62 so that each prying element is associated with a guide member on each side of the prying element. However, the prying member 61 could direct the removed shingles to shingle disposal section 60, alleviating the need for the guide members.

The invention further includes a cutting member 67 for cutting the removed shingles into shingle pieces. In the illustrated embodiment, cutting member 67 is disposed in shingle disposal section 60 and comprises a plurality of blades 50 and a cutting bar 72 that are carried across a width substantially the same as prying width W. Cutting bar 72 includes a plurality of slots 74 that are positioned such that when blades 50 are rotatably driven by primary cutting drive shaft 44, they pass through slots as they rotate without contacting cutting bar.

Figure 4B:
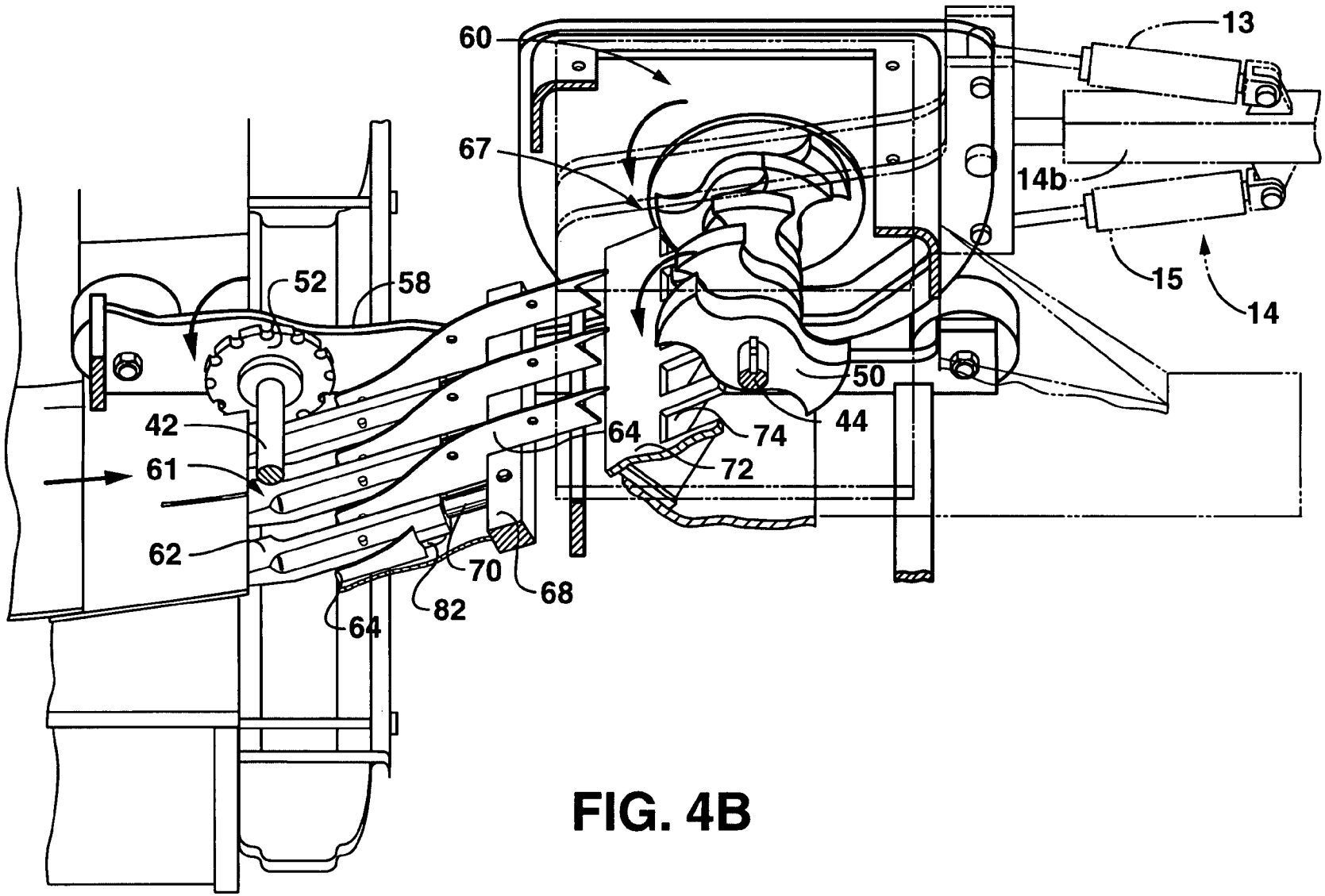
Figure 4C:
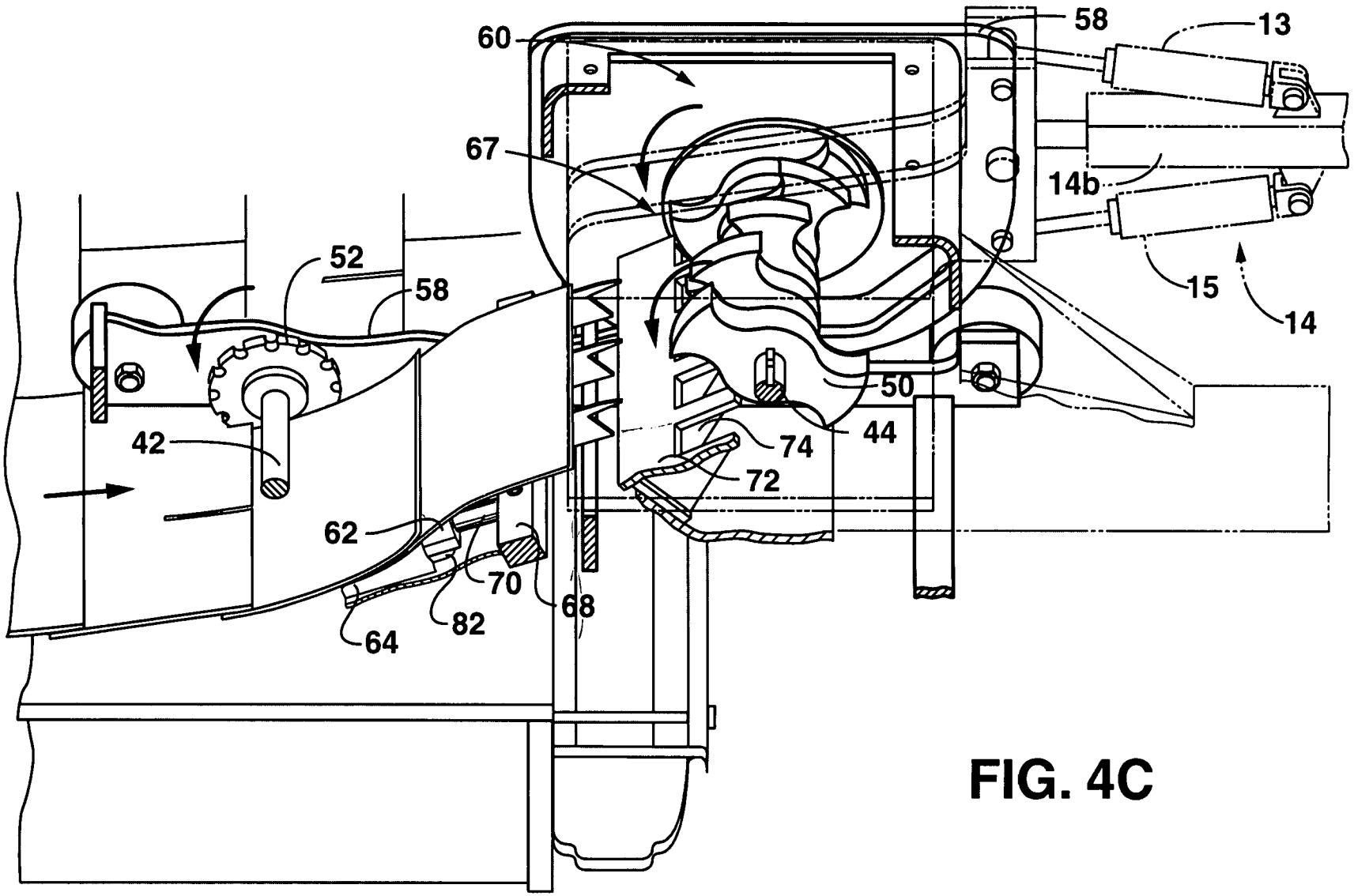

As can be seen in FIGS. 4B and 4C, shingle removal head 12 is moved by boom arm assembly 14 from the bottom of the roof near the gutter towards the apex of the roof. As the shingle removal head engages the roof, prying elements 62 slide between the surface of the roof and the leading edges of the shingles, thus lifting them from the surface of the roof. Because of the overlapping nature of the shingles, once prying elements 62 engage the underside of the first row of shingles, the prying members are able to easily slide between the surface of the roof and the shingles in successive rows. As shingle removal head 12 is moved toward the apex of the roof, the force of gravity and the resistance of the shingles still secured to the surface of the roof force the removed shingles up guide members 64 and into shingle disposal section 60.

Figure 4D:
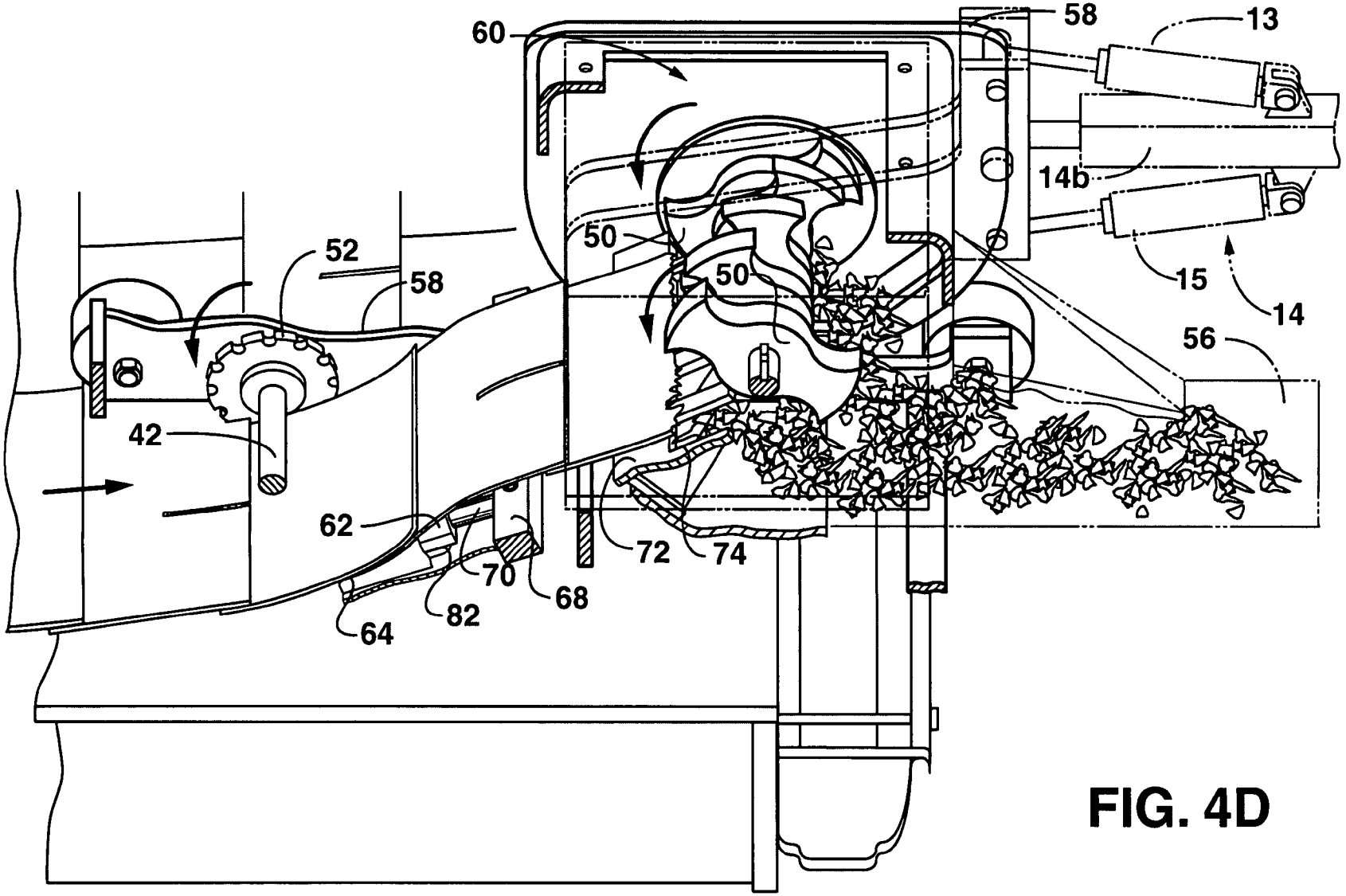

Referring now to FIGS. 4C and 4D, as the removed shingles are forced into shingle disposal area 60, the removed shingles rest upon and at least partially obscure cutting bar 72 and thus slots 74. When blades 50 rotate in a downward or counter-clockwise direction in relation to cutting bar 72 blades 50 pass through slots 74 and any portion of the shingles covering the slots is cut or otherwise shredded into a smaller pieces. The primary purpose of cutting member 67 is to cut the removed shingles into a size that is more easily removed from shingle disposal section 60 by the vacuum unit 22. Once cut, the shingle pieces may then be removed from shingle disposal section 60 by the vacuum unit 22.

While the illustrated embodiment includes a plurality of blades 50 and corresponding slots 74, any number of blades and slots may be used as long as the positioning of slots 74 corresponds with the positioning of blades 50 so that when rotating, the blade(s) may pass through the slot(s). While the invention may include a greater number of slots 74 than blades 50, the number of slots 74 must always be at least equal to the number of blades so that the blades may rotate freely. However, any cutting member generally known in the art such as grinders, shredders, plurality of angled blades or other member having a first and second cutting surface for cutting materials may be used.

As illustrated, shingle disposal section 60 and cutting member 67 are disposed rearward of prying elements 62. However, to decrease the total length of shingle removal head 12, shingle disposal section 60 and cutting member 67 may be disposed above prying elements 62 such that cutting bar 72 and plurality of blades 50 are disposed above guide members 64. As shingles are removed by prying elements 62, the shingles are directed up guide members 64. Because in this embodiment the cutting bar 72 is located above the guide members 64 rather than in the same plane or below the guide members, plurality of blades 50 rotate in an upward, counter-clockwise motion rather than the downward counter-clockwise motion illustrated. Therefore, in order to avoid contact with guide members 64, the positioning of the plurality of blades 50 and slots 74 should align with the spacing between each guide member or be spaced slightly rearward of guide members 64.

Figure 5:
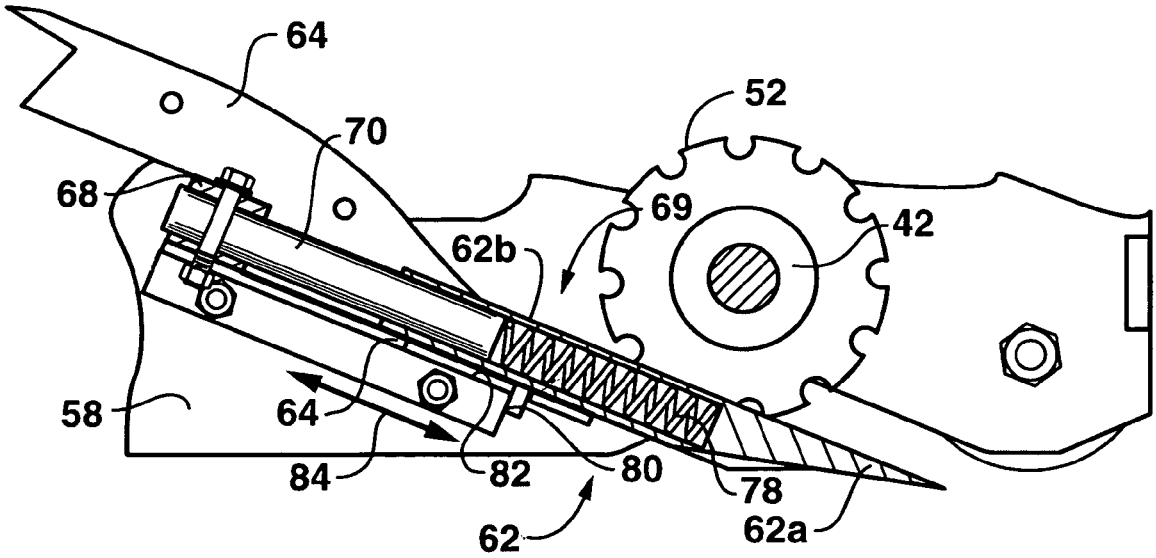

Referring now to FIG. 5, each prying element 62 includes a safety mechanism generally shown as 69 operatively connecting prying element 62 to the frame 58 such that each prying element is independently spring biased from a support rod 70. The support rod 70 is carried by a support member 68 included on head frame 58. Prying element 62 has a first section 62*a* that is solid and tapered so that it may be wedged between the surface of a roof and the shingles secured to the roof. Prying element 62 also has a second section 62*b* that defines a hollow passage which constitutes a bore for receiving support rod 70 and housing a spring 78. Collectively, support rod 70, the bore defined by second section of prying member 62*b* and spring 78 comprise safety mechanism 69 for allowing lateral movement of each individual prying element 62 along a longitudinal axis 84 of prying element 62. Safety mechanism 69 allows each of the prying members 62 to move independently of one another along longitudinal axis 84.

As can best be seen in FIG. 4A, guide members 64 include a bottom plate that is disposed beneath prying elements and carried across prying width W. Guide member includes a plurality of slots 82 in the bottom plate that correspond with guide pins, which are shown as 80 in FIG. 5, that are included on the underside of prying elements 62. Guide pin 80 limits the lateral movement of prying elements 62 allowed by safety mechanism 69. Guide pin rests in slot 82 defined in the bottom plate of guide members 64, which may be more clearly seen in FIGS. 4A, 4B, 4C and 4D.

Support rod 70 extends outwardly from support member 68 along the longitudinal axis 84 of prying element 62. Each prying element 62 is spring biased from support rod 70 to allow each of the prying elements to independently retract along longitudinal axis 84 when the prying element contacts a elevated obstruction on the roof such as a non-uniform piece of the roof surface. Because of the angle of longitudinal axis 84 along which support rod 70 extends from support member 68, when a prying element retracts along longitudinal axis 84, the prying element simultaneously moves in a horizontal and vertical direction, causing the prying element to retract to a rearward, elevated position. Guide pin 80 controls the distance that prying element 62 may retract. As prying element retracts, guide pin 80 slides through slot 82. Once the end of slot 82 has been reached by guide pin 80, prying element 62 is prevented from retracting any farther.

The lateral movement allowed by safety mechanism 69 helps to prevent the prying elements from tearing anything from the roof that should not be removed. For instance if a portion of the surface of the roof is uneven or otherwise not uniform with the remainder of the roof, it is likely that the prying elements would wedge themselves under that portion of the roof and tear it from the roof. In order to prevent this, the lateral movement allows each of the prying elements to change elevation with respect to the surface of the roof and pass over the elevated obstruction. Therefore, if one or more of the prying elements snags or otherwise engages a non-uniform portion of the roof, those prying elements 62 will retract independently of one another along longitudinal axis 84, relieving the pressure exerted on the surface of the roof until the elevation of the prying element is increased enough to pass over the non-uniform portion of the roof.

By allowing prying elements 62 to retract independently from one another, the maximum amount of prying elements 62 are kept in contact with the roof while allowing only those prying elements that have contacted the elevated obstruction to retract. Further, to ensure that each prying element retracts only when in contact with an elevated obstruction, spring 78 should have such a tension that prying elements 62 will not retract when prying shingles from the surface of the roof but only when prying elements 62 come in contact with an elevated obstruction such as a non-uniform portion of the roof.

While not having all of the above described advantages of the plurality of prying elements 62 that are independently spring biased, a unitary prying member such as a single plate may be used. While the unitary prying member may still include a safety mechanism for allowing lateral movement upon contact of an elevated obstruction, the entire prying member will be elevated upon contact rather than just one of the prying elements 62. Therefore, the unitary prying member may miss shingles to the left or right of the elevated obstruction because the entire prying member will be elevated from the roof rather than just a portion of the prying member as is the case when prying member 61 comprises a plurality of individual prying elements 62.

While a preferred embodiment of the invention has been described using specific terms, such description is for illustrative purposes only, and it is to be understood that changes and variations may be made without departing from the spirit or scope of the following claims.

What is claimed is:

1. An apparatus for removing shingles from the surface of a roof comprising:

a moveable shingle removal head having a head frame;

a prying member comprising a plurality of prying elements individually and reciprocally biased across a prying width of said head frame for lifting and removing shingles from the surface of the roof and allowing biased reciprocal movement of said prying elements along a longitudinal axis for retraction of one or more of said prying elements upon contacting an elevated obstruction on the roof;

a cutting member carried by said head frame for cutting the removed shingles into smaller shingle pieces; and a shingle disposal section carried by said head frame for receiving the shingle pieces;

a shingle outlet formed in said shingle disposal section for the removal of the shingle pieces from said shingle disposal section;

whereby, when said apparatus is positioned and moved over shingles on a roof, said prying member engages beneath free edges of the shingles to lift and remove the shingles for being cut into shingle pieces for removal from said shingle disposal section through said shingle outlet wherein contact of one or more of said prying elements with the elevated obstruction causes said one or more prying elements to retract along said axis into a position elevated from the obstruction allowing said one or more of prying elements to continue operative movement over the surface of the roof, while allowing a remainder of said prying elements to continue operative movement over the surface of the roof without retracting.

2. The invention of claim 1 further including a guide member carried by said head frame with said prying member for directing the shingles removed by said prying member toward said shingle disposal section.

3. The invention of claim 1 further including guide members carried adjacent said prying elements for directing the shingles removed by said prying elements toward said shingle disposal section.

4. The invention of claim 1 further including a width trimming member carried by said head frame and disposed adjacent the two outermost of said prying elements for defining said prying width by cutting a predetermined width of shingles to be removed from the roof by said prying elements.

5. The invention of claim 1 further including a width trimming member carried by said head frame and disposed adjacent said prying member for defining said prying width by cutting a predetermined width of shingles to be removed from the roof by said prying member.

6. The invention of claim 1 further including a vacuum unit connected to said shingle outlet by a vacuum hose for removing the shingle pieces from said shingle disposal section.

7. The invention of claim 1 further including a boom arm assembly for carrying and remotely operating said shingle removal head so that said boom arm assembly causes said head frame to be positioned and moved over the surface of the roof thereby removing shingles from the surface of the roof.

8. The invention of claim 1 wherein said cutting member comprises a rotatable blade and a cutting bar having a slot corresponding to said blade so that when said blade is rotated, it passes through said slot to break said removed shingles into the smaller shingle pieces.

9. A ground based shingle removal system for removing shingles from a roof comprising:

a mobile transportation unit stationed on the ground;

a moveable boom arm assembly carried by said transportation unit;

a shingle removal head for removing shingles from the roof carried by said boom arm assembly;

a prying member carried by said and comprising a plurality of prying elements individually and reciprocally biased across a prying width of said shingle removal head for lifting and removing shingles from the surface of the roof and allowing biased reciprocal movement of said prying elements along a longitudinal axis for retraction of one or more of said prying elements upon contacting an elevated obstruction on the roof;

said boom arm assembly being remotely operable for moving said shingle removal head over the roof so that said prying member removes shingles from a desired area of the roof;

a vacuum unit carried by said transportation unit, said vacuum unit including a vacuum hose carried by said boom arm assembly and connected to said head for transporting the removed shingles to the ground; and a cutting member carried by said head and disposed adjacent said prying member for receiving the removed shingles and cutting the shingles into smaller pieces to be removed by said vacuum unit.

10. The invention of claim 9 wherein said boom arm assembly includes two articulating arms including a base arm and an extension arm;

Said base arm being rotatably carried by said transport unit about a vertical axis;

Said extension arm being pivotally carried by said base arm on which said removal head is carried.

11. The invention of claim 10 further including an adjustable connector for adjusting the angle at which said head is carried by said extension arm so as to match the angle at which said head is carried by said extension arm to the pitch of the roof.

12. The invention of claim 11 wherein said adjustable connector comprises a fluid cylinder connected to said head having the ability to extend and retract to adjust the angle at which said head is carried by said extension arm.

13. The invention of claim 10 wherein said extension arm includes a telescopic arm extendable to move said head over selected areas of the roof.

14. The invention of claim 9 further including a containment bin carried by said transportation unit and operatively associated with said vacuum unit for storing the shingles transported by said vacuum unit.

15. The invention of claim 9 further including a width trimming member carried by said head and disposed adjacent said shingle prying member for cutting a predetermined width of shingles to be removed from the surface of the roof by said prying member.

16. An apparatus moveable over the surface of a roof for removing shingles from the surface of the roof without damaging the roof comprising:

a portable shingle removal head having a head frame;

a prying member carried by said head frame and comprising a plurality of prying elements individually and reciprocally biased across said head frame for lifting and removing shingles from the surface of the roof and allowing biased reciprocal movement of said prying elements along a longitudinal axis for retraction of one or more of said prying elements upon contacting an elevated obstruction on the roof;

a width trimming member carried by said head frame and disposed adjacent the two outermost of said prying elements for defining a prying width by cutting a predetermined width of shingles to be removed from the roof by said prying elements;

whereby, when said apparatus is positioned and moved over shingles on a roof, said prying member engages beneath free edges of the shingles located within said prying width to lift and remove the shingles, wherein contact of one or more of said prying elements with the elevated obstruction causes said one or more prying elements to retract along said axis into a position elevated from the obstruction allowing said one or more of prying elements to continue operative movement over the surface of the roof, while allowing a remainder of said prying elements to continue operative movement over the surface of the roof without retracting.

17. The invention of claim 16 further including a boom arm assembly for carrying and remotely operating said shingle removal head so that said boom arm assembly causes said head frame to be positioned and moved over the surface of the roof thereby removing shingles from the surface of the roof.

18. A method for removing shingles from a roof and delivering the removed shingles to a ground unit comprising the steps of:

providing a shingle removal head that includes a prying member having a plurality of prying elements individually and reciprocally biased across said removal head for lifting and removing shingles from the surface of the roof and allowing biased reciprocal movement of said prying elements along a longitudinal axis for retraction of one or more of said prying elements upon contacting an elevated obstruction on the roof; and moving the removal head over the roof so that said prying member engages beneath free edges of the shingles to lift and remove the shingles from the roof, wherein contact of one or more of said prying elements with the elevated obstruction causes said one or more prying elements to retract along said axis into a position elevated from the obstruction allowing said one or more of prying elements to continue operative movement over the surface of the roof, while allowing a remainder of said prying elements to continue operative movement over the surface of the roof without retracting; and, cutting the removed shingles into smaller shingle pieces and delivering the shingle pieces to a ground unit.

19. The method of claim 18 further comprising the steps of:

delivering said shingle pieces from the roof using a vacuum unit based at a ground unit.

20. The method of claim 19 comprising the steps of:

using a vacuum hose connected to the shingle removal head and the vacuum unit for receiving and delivering the shingle pieces from the head to the vacuum unit on the ground.

* * * * *